US010000967B2

(12) United States Patent
Huang et al.

(10) Patent No.: US 10,000,967 B2
(45) Date of Patent: Jun. 19, 2018

(54) CURTAIN BLINDS SPRING MOTOR ELASTICITY MAINTAINING STRUCTURE

(71) Applicants: Hsien-Te Huang, Taipei (TW); Yu-Wei Huang, Taipei (TW)

(72) Inventors: Hsien-Te Huang, Taipei (TW); Yu-Wei Huang, Taipei (TW)

( * ) Notice: Subject to any disclaimer, the term of this patent is extended or adjusted under 35 U.S.C. 154(b) by 29 days.

(21) Appl. No.: 15/194,168

(22) Filed: Jun. 27, 2016

(65) Prior Publication Data

US 2017/0022755 A1 Jan. 26, 2017

(30) Foreign Application Priority Data

Jul. 20, 2015 (TW) ..... 104211709 U

(51) Int. Cl.
*E06B 9/60* (2006.01)
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/3222; E06B 9/60
See application file for complete search history.

(56) References Cited

U.S. PATENT DOCUMENTS 6,149,094 A * 11/2000 Martin ..... E06B 9/322 160/168.1 P
2006/0065373 A1* 3/2006 Chen ..... E06B 9/322 160/170
2012/0061037 A1* 3/2012 Chen ..... E06B 9/42 160/315
2016/0280506 A1* 9/2016 Huang ..... E06B 9/60

* cited by examiner

*Primary Examiner* — Sang K Kim
(74) *Attorney, Agent, or Firm* — Muncy, Geissler, Olds & Lowe, P.C.

(57) ABSTRACT

A curtain blinds spring motor elasticity maintaining structure, which provides a spring motor structure that prevents unproductive deformation and loss of elastic stress in a sheet band of a coil spring. The structure primarily consists of a kidney shaped wheel face provided on the outer circumferential surface of a drive drum. A first wound layer, a second wound layer, and a third wound layer of the sheet band are pulled and wound onto the drive drum to form a pressure accumulating coil, thereby arranging an anticipated configuration of curved tight windings of each of the wound layers along the kidney shaped wheel face, which prevents changes in the cross-sectional curvature of the sheet band and loss in elastic stress thereof, and thus maintaining an appropriate elastic force.

2 Claims, 11 Drawing Sheets

CURTAIN BLINDS SPRING MOTOR ELASTICITY MAINTAINING STRUCTURE

BACKGROUND OF THE INVENTION (a) Field of the Invention

A curtain blinds spring motor elasticity maintaining structure, for use with a window curtain blind set that applies a horizontal taking-in and letting-down operation that is provided with a self-contained feedback function for taking up the curtain blinds. The structure primarily consists of a spring motor structure that prevents unproductive deformation and loss of elastic stress in a sheet band of a coil spring.

(b) Description of the Prior Art

Referring to FIG. 1, which shows a window curtain blind set 100 provided with an elastic self-contained feedback function to take up curtain blinds 15, which is basically installed with a spring motor 10 provided with an elastic feedback function. Two sides of the spring motor 10 respectively connectively drive curtain pull cords 14 to achieve a taking-up and letting-down operation of the curtain pull cords 14. Accordingly, the curtain blinds 15 are let down when the curtain pull cords 14 are let down, and when a self-contained feedback take-up operation is performed, the curtain pull cords 14 are taken up, which connectively drives the complete taking up of the curtain blinds 15. The spring motor 10 comprises a coil spring 4, which uses coiling of the coil spring 4 under the pulling of an external force to let down the curtain blinds 15, and at the same time reversely stored elastic deformation energy back feeds the actuation of two side spools 13, and corresponding ends of the curtain pull cords 14 are wound onto the respective wheel faces of the two side spools 13 to completely take up the curtain blinds 15.

Referring to FIG. 2, which shows the spring motor 10 installed with a take-up drum 2 and an idler gear 5, wherein the take-up drum 2 has no rotational speed relationship with the idler gear 5, and the take-up drum 2 and the idler gear 5 are in a coaxial relationship. The spring motor 10 is further installed with a linkage gear 30 that connects with the idler gear 5 through parallel-axes meshing. The linkage gear 30 integrally connectively drives a drive drum 3, enabling front and rear connection between the take-up drum 2 and the drive drum 3 through the coil spring 4. When there is no external force being applied, the coil spring 4 forms a reset coil 41 that is coiled round the outer circumference of the take-up drum 2, while another end of the coil spring 4 connectively drives the outer circumference of the drive drum 3. When the spools 13 are actuated by pulling on the curtain pull cords 14, the spools 13 further respectively connectively drive driven gears 131 with shafts 130 respectively serving as centers of rotation. The driven gear 131 meshes with the linkage gear 30, and the linkage gear 30 further coaxial connects to the drive drum 3, whereupon a sheet band 400 is pulled and wound onto the outer circumferential surface of the drive drum 3, at which time deformation of the sheet band 400 is used to produce elastic accumulation energy. Furthermore, the idler gear 5 is in a separation rotary motion relationship with the take-up drum 2, but the idler gear 5 meshes with the linkage gear 30. Another end of the idler gear 5 further meshes with the right side driven gear 131, and the driven gear 131 forms a single body with the spool 13, thereby enabling synchronous rotation through the support of the right side shaft 130. Hence, the surface of the spool 13 enables winding-unwinding of the right side curtain pull cord 14 thereon.

Referring to FIG. 3 (together with FIG. 2), which shows connection of the sheet band 400 to the reset coil 41. After pulling the curtain pull cords 14, one end of the drive drum 3 forms a pressure accumulating coil 42, and under the effect of an external force, the coil spring 4 restores the reset coil 41.

Referring further to FIG. 4, which shows the drive drum 3 and the linkage gear 30 in a coaxially interconnected relationship, with the take-up drum 2 and the idler gear 5 in a separation rotary motion relationship. When there is no external force burden being imposed on the sheet band 400 of the coil spring 4, the sheet band 400 is wound up according to the outer circumferential surface of the take-up drum 2 to form the reset coil 41, and the reset coil 41 forms a convex drum shape, the reason for which is that the body of the sheet band 400 itself uses the cross-sectional curvature to produce elastic stress, and changes in the cross-sectional curvature of the sheet band 400 form an elastic reaction force. The installed drive drum 3 is a round shaft shaped cylindrical body of uniform radius in common use. Hence, as shown in FIG. 2, the sheet band 400 is actuated by the curtain pull cords 14, which pulls and winds the sheet band 400 onto the outer circumferential surface of the drive drum 3 to form a pressure accumulating coil 42. A first wound layer 421, a second wound layer 422, a third wound layer 423 . . . of the pressure accumulating coil 42 are sequentially overlapped onto the outer circumference of the drive drum 3.

Because the outer circumference of the drive drum 3 is a cylindrical form of uniform radius, and the surface thereof is a round flat surface, thus, the pressure accumulating coil 42 formed after winding the sheet band 400 onto the drive drum 3, the inner and outer windings of each of the wound layers including the first wound layer 421, the second wound layer 422, the third wound layer 423 . . . are sequentially pressed flat by a pulling force. In particular, the cross-sectional curvature of the inner winding of the first wound layer 421 will be flattened.

Referring to FIG. 5, which shows changes in the aforementioned flattening. The drive drum 3 is a round cylindrical shaft form of uniform radius, and the sheet band 400 is wound thereon in wound layers to form the pressure accumulating coil 42, wherein the first wound layer 421, the second wound layer 422, and the third wound layer 423 are pulled by two side pulling forces F2 and F3, subjecting the center of the band body of the sheet band 400 to the flat surface center point of contact of the drive drum 3 therewith, which produces a reverse pressing force F1. Hence, the pressure accumulating coil 42 wound round and formed on the drive drum 3 with a flat round surface, similar to that shown in FIG. 4, forms flat overlapping layers. The flat overlapping layers then force changes in the degree of curvature of the arched cross section of the sheet band 400 to occur. If the changes occur within a short period of time, then recovery is immediate, and the elastic stress will not have a large affect on the cross-sectional curvature of the sheet band 400. However, in general, curtains are continuously in a let-down mode for over 10 hours during the day, which causes the pressing force F1 and the pulling forces F2 and F3 to accumulate pressure over a long period of time that produces pressure deformation in the cross-sectional curvature of the sheet band 400, thereby causing changes in the cross-sectional curvature of the sheet band 400 and loss in elastic stress, and is thus unable to maintain its appropriate elastic recovery capacity.

SUMMARY OF THE INVENTION

The primary objective of the present invention lies in providing a curtain blinds spring motor elasticity maintaining structure, which prevents unproductive deformation and loss of elastic stress in a sheet band of a coil spring. And primarily comprises the outer circumferential surface of a drive drum provided with a kidney shaped wheel face, which enables the pull winding of a first wound layer, a second wound layer, and a third wound layer of the sheet band onto the drive drum to form a pressure accumulating coil, thereby arranging an anticipated configuration of curved tight windings of each of the wound layers along the kidney shaped wheel face, preventing changes in the cross-sectional curvature of the sheet band and loss in elastic stress, and thus maintaining an appropriate elastic force.

A second objective of the present invention lies in the drive drum being coaxially assembled with a linkage gear, with the linkage gear outwardly connectively driving a driven gear. Accordingly, with a shaft body as center, the driven gear synchronously drives a spool, and the linkage gear coupled to the drive drum outward meshes with a driven gear at another end of the spring motor through an idler gear positioned on a supporting shaft and coaxial with a take-up drum. The driven gear at the other end is supported by a shaft thereat and connectively drives another spool, which enables the taking up and letting down of a curtain pull cord on that side.

A third objective of the present invention lies in the center of the drive drum being provided with an outward opening link angled hole. After actuation of the drive drum by an angled tool, the sheet band is wound round to assemble a coil spring, and after withdrawing the winding assembly force, the coil spring is reset as a reset coil. The process of connectively driving the spools on the two sides is used to complete the assembling operation of the two side curtain pull cords.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 6:
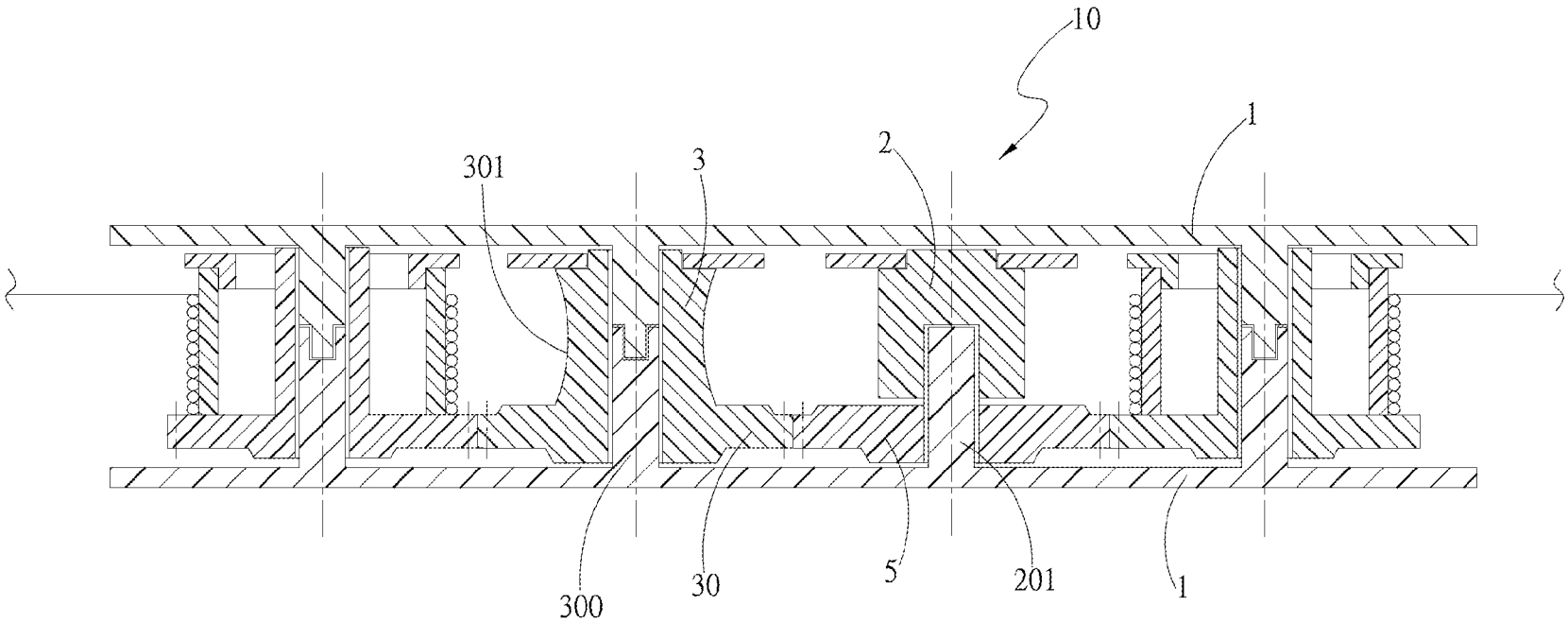
FIG. 6 is a cross-sectional structural schematic view of a drive drum provided with a kidney shaped wheel face according to the present invention.

Referring to FIG. 6, which shows a spring motor 10 of the present invention installed with upper and lower side plates 1, a supporting shaft 201 fixed to the side plate 1, and a working end shaft 300. The supporting shaft 201 enables a take-up drum 2 to be pivotal disposed thereon, and coaxially enables an idler gear 5 to be movable disposed thereon. The working end shaft 300 enables a drive drum 3 to be movable disposed thereon, and the drive drum 3 connectively drives a linkage gear 30. The linkage gear 30 and the idler gear 5 are in a mutual meshing relationship, and the outer circumferential surface of the installed drive drum 3 is formed with a concave kidney shaped wheel face 301.

Figure 1:
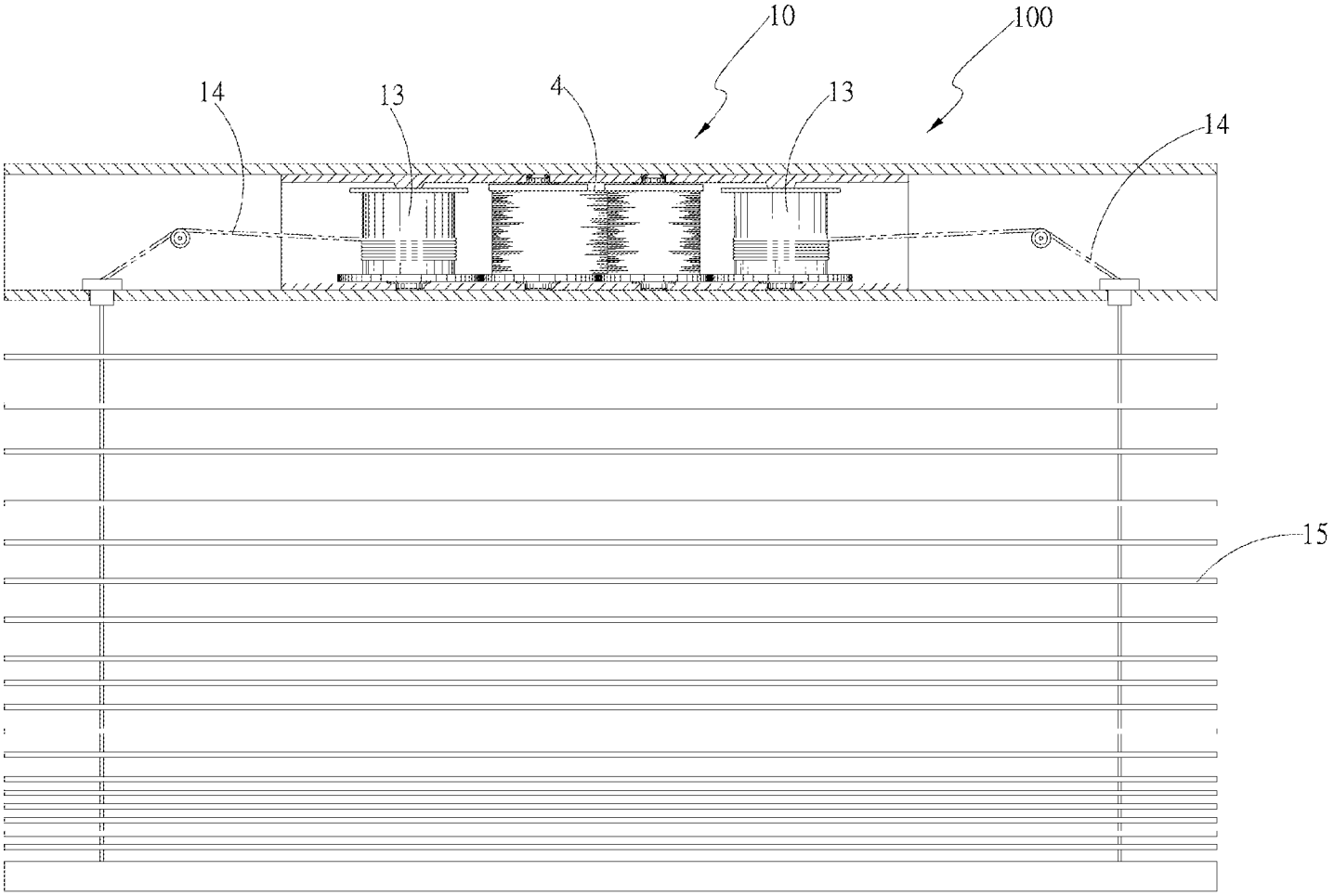
FIG.1 Prior Art
FIG. 1 is a structural schematic view of a window curtain blind set fitted with a spring motor of the prior art.
Figure 2:
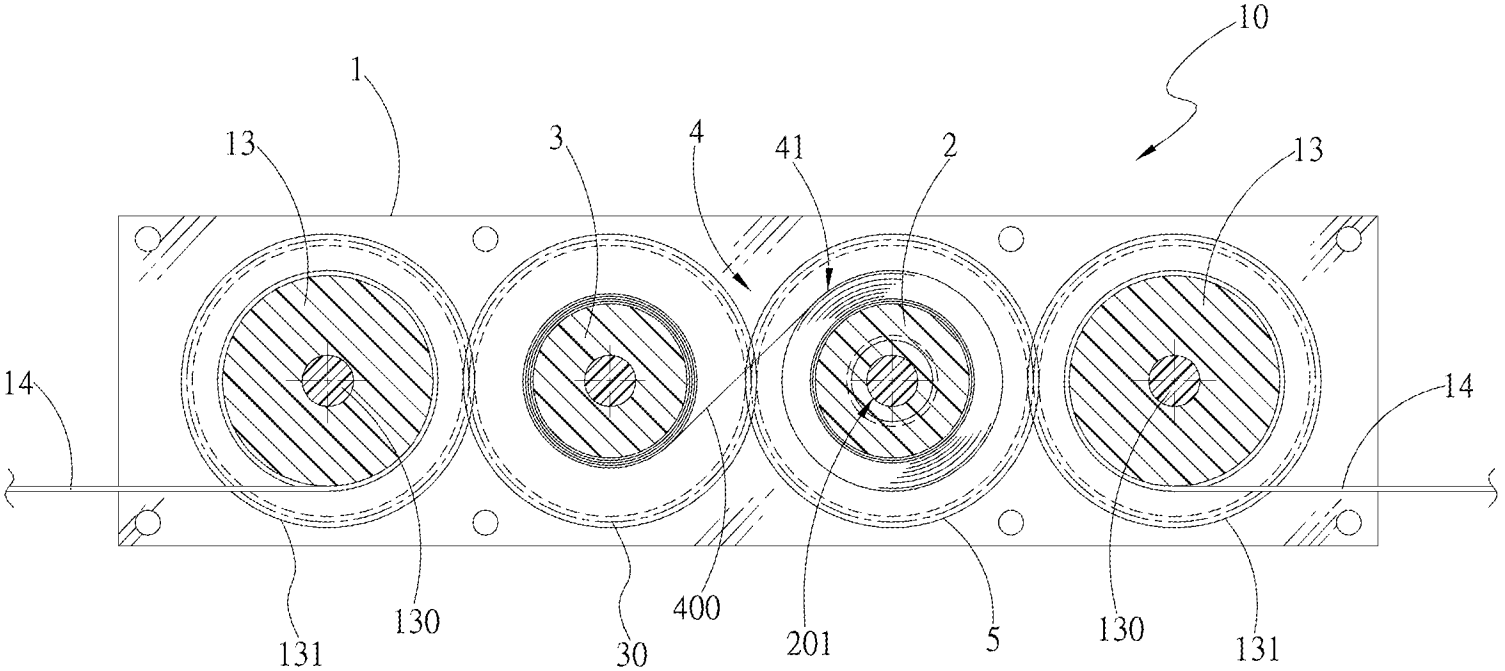
FIG.2 Prior Art
FIG. 2 is a top view of the operating principle of the spring motor of the prior art.
Figure 3:
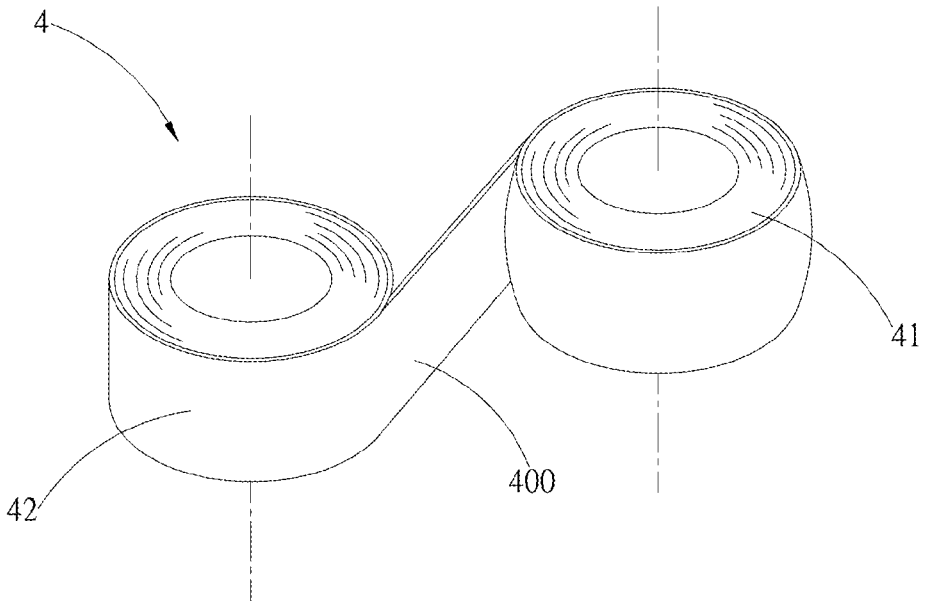
FIG.3 Prior Art
FIG. 3 is a schematic view depicting operation of a coil spring of the prior art.
Figure 7:
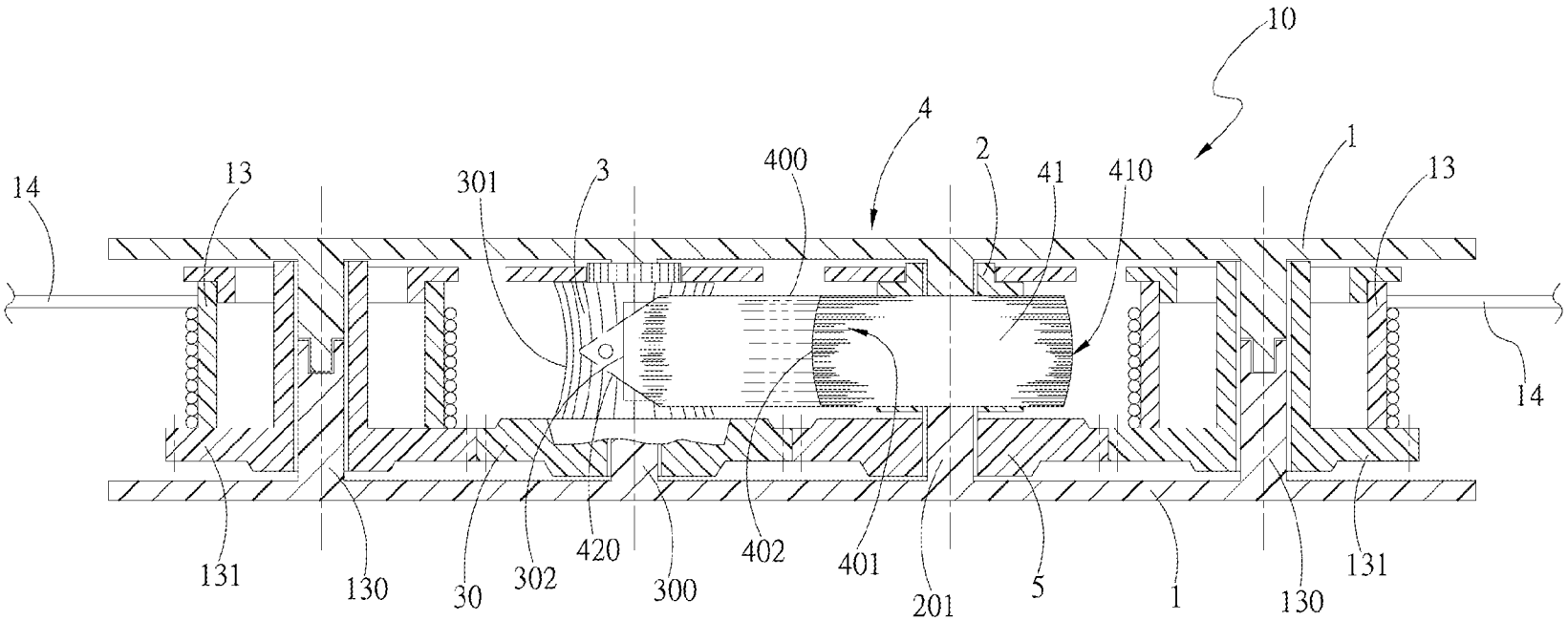
FIG. 7 is a preliminary schematic view of a spring motor enabling connection of a sheet band thereto according to the present invention.

Referring to FIG. 7, which shows an embodiment of the spring motor 10 of the present invention, wherein the supporting shaft 201 parallel to the axis line is perpendicularly installed relatively between the inner sides of the two upper and lower side plates 1, with the working end shaft 300 parallel to the supporting shaft 201 and parallel shafts 130 respectively positioned on the left and right sides of the spring motor 10. The shafts 130 on the two sides of the spring motor 10 enable spools 13 on the respective two sides to be movable disposed thereon. The outer circumferential surfaces of the two side spools 13 respectively enable the taking-in and letting-down of two side curtain pull cords 14. A driven gear 131 connects axially to one end to each of the two side spools 13. The supporting shaft 201 enables the idler gear 5 to be movable disposed thereon, and the working end shaft 300 enables the drive drum 3 to be movable disposed thereon. The idler gear 5 and the take-up drum 2 are coaxially interconnected, but are in a separation rotational relationship. A sheet band 400 provided on the coil spring 4 respectively connects with the take-up drum 2 and the drive drum 3. Under conditions whereby there is no external force burden, the sheet band 400 is wound onto the outer circumference of the take-up drum 2 to form a reset coil 41. A band head 420 provided on a protruding end of the sheet band 400 is fastened to a clasping portion 302 that is inwardly configured on the outer circumferential surface of the drive drum 3, and the outer circumference of the drive drum 3 is the arched concave kidney shaped wheel face 301. When there is no external force being exerted, the coil spring 4 rolls up on its own to take the form of the reset coil 41, which has a drum side 410 with a protruding midsection. The shape of the drum side 410 is formed by the cross-sectional curvature of the sheet band 400. Operational changes in the sheet band 400 (as shown in FIG. 3) are from the rear side of the reset coil 41 transforming to angular enter the front side of the drive drum 3 and winding onto the surface of the kidney shaped wheel face 301 of the drive drum 3, with an inner arch face 401 of the sheet band 400 (referring to FIG. 8) being wound onto the outer circumference surface of the take-up drum 2 to form the reset coil 41. When force is exerted on the curtain pull cords 14, the force passes through the spool 13 which connectively drives the driven gear 131, thereafter driving the linkage gear 30. The linkage gear 30 then connectively drives and rotates the drive drum 3. The outer arch face 402 of the sheet band 400 is then wound and wrapped one layer at a time onto the drive drum 3 according to the arched concave curvature of the kidney shaped wheel face 301, gradually producing an elastic resetting feedback energy.

Figure 4:
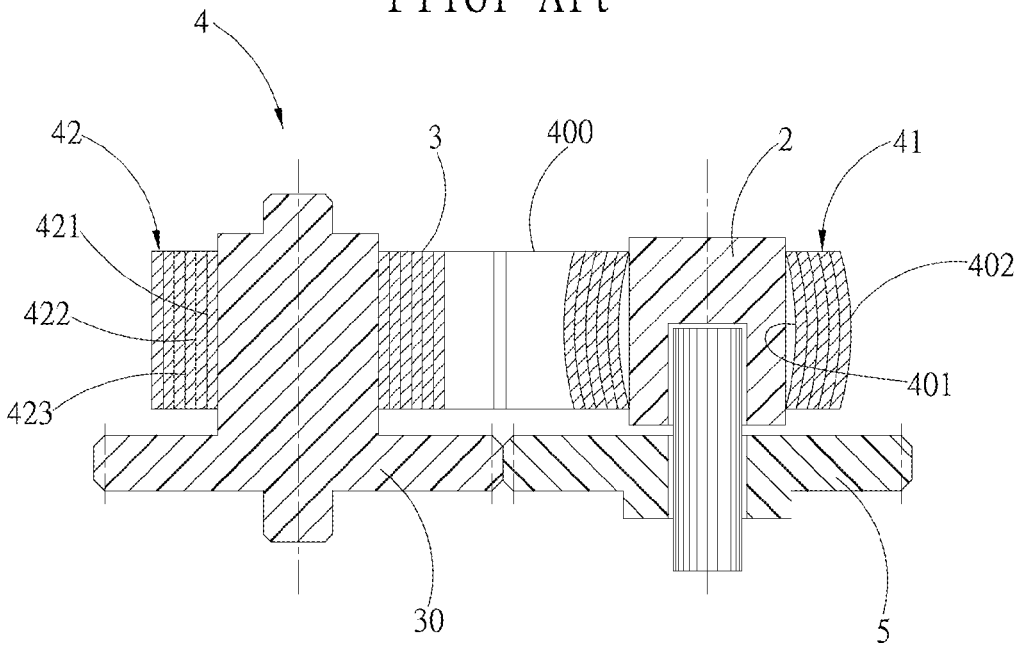
FIG.4 Prior Art
FIG. 4 is a cross-sectional view of a drive drum enabling the winding round of a sheet band to form a pressure accumulating coil according to the prior art.
Figure 5:
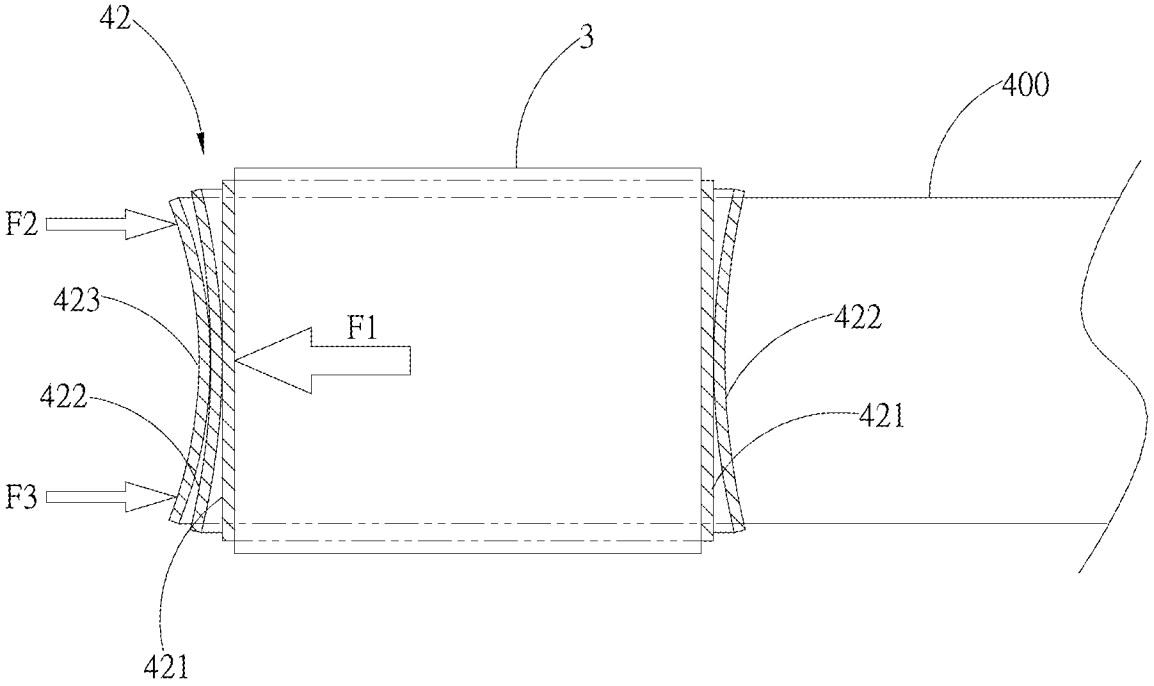
FIG. 5 Prior Art
FIG. 5 is a change diagram depicting the winding round of the sheet band to form the pressure accumulating coil on the flat outer circumferential surface of the drive drum according to the prior art.
Figure 8:
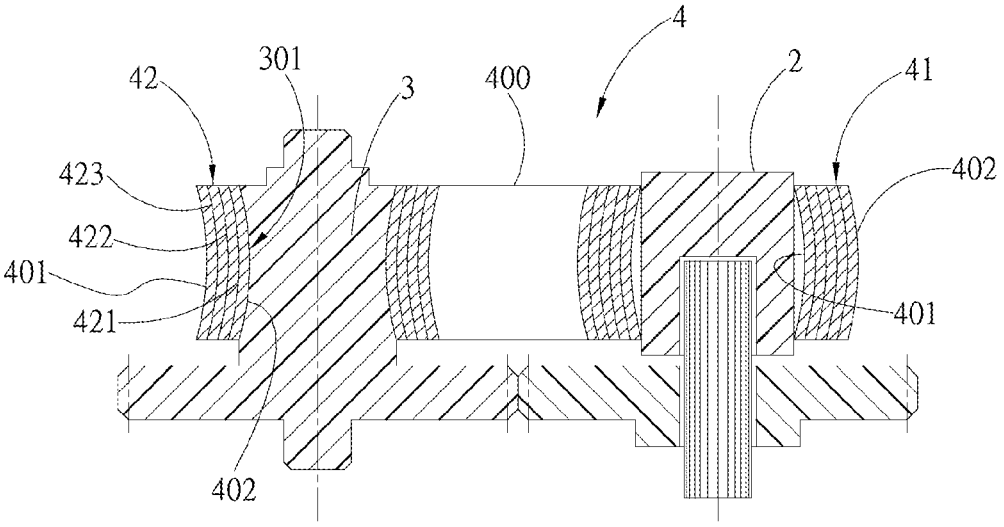
FIG. 8 is a schematic relationship view of the kidney shaped wheel face provided on the drive drum enabling winding round of a pressure accumulating coil thereon according to the present invention.

Referring to FIG. 8, which shows the concave curved kidney shaped wheel face 301 of the outer circumferential surface of the drive drum 3, wherein the curvature of the kidney shaped wheel face 301 is in contrast to the cross-sectional curvature of the sheet band 400. The reset coil 41 extending from the sheet band 400 frontward winds onto the drive drum 3 at an alternate angle. The drive drum 3 rotates in a clockwise direction, and the outer arch face 402 of the sheet band 400 overlays onto the kidney shaped wheel face 301 provided with an appropriate degree of curvature. The sheet band 400 is wound round and wrapped onto the drive drum 3 to form a first wound layer 421, a second wound layer 422, and a third wound layer 423 of a pressure accumulating coil 42. Because the layers pile up with the same degree of curvature, thus, the cross-sectional curvature of the sheet band 400 is able to maintain a constant shape, and will not result in cross-sectional variation as shown in FIG. 4 of the prior art. The cross-sectional curvature of the sheet band 400 of the present invention is maintained, thereby preventing elastic deformation of the cross-sectional curvature of the band body from occurring, which would otherwise result in loss of elastic stress.

Figure 9:
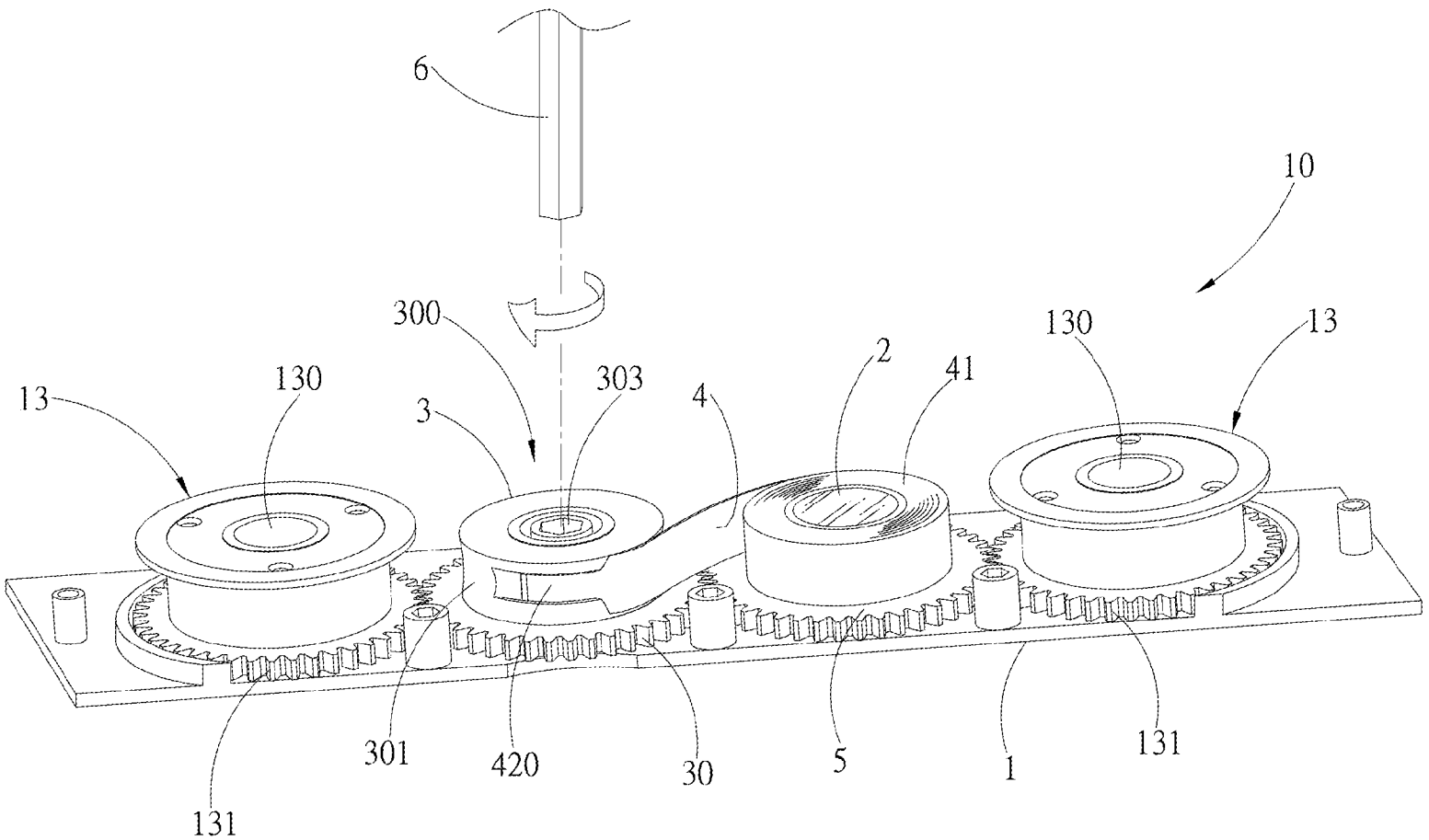
FIG. 9 is a schematic relationship view of the drive drum provided with an link angled hole enabling actuation by a tool according to the present invention.

Referring to FIG. 9, which shows the spring motor 10 of the present invention installed with the side plate 1. The drive drum 3 and the take-up drum 2 are perpendicularly disposed on the surface of the side plate 1, and the take-up drum 2 is coaxially assembled to the idler gear 5, but the two are in a separation rotational speed relationship. The idler gear 5 meshes with the linkage gear 30 that is connected to the drive drum 3. The idler gear 5 and the linkage gear 30 further respectively outwardly drive the driven gears 131 separately associated therewith. And the two side driven gears 131 are coaxially linked to the two side spools 13 separately associated therewith.

The center of the drive drum 3 is provided with an outward opening link angled hole 303. The link angled hole 303 enables an angled tool 6 to be movable joined therein, which, after rotating the angled tool 6, connectively drives and rotates the drive drum 3.

Figure 10:
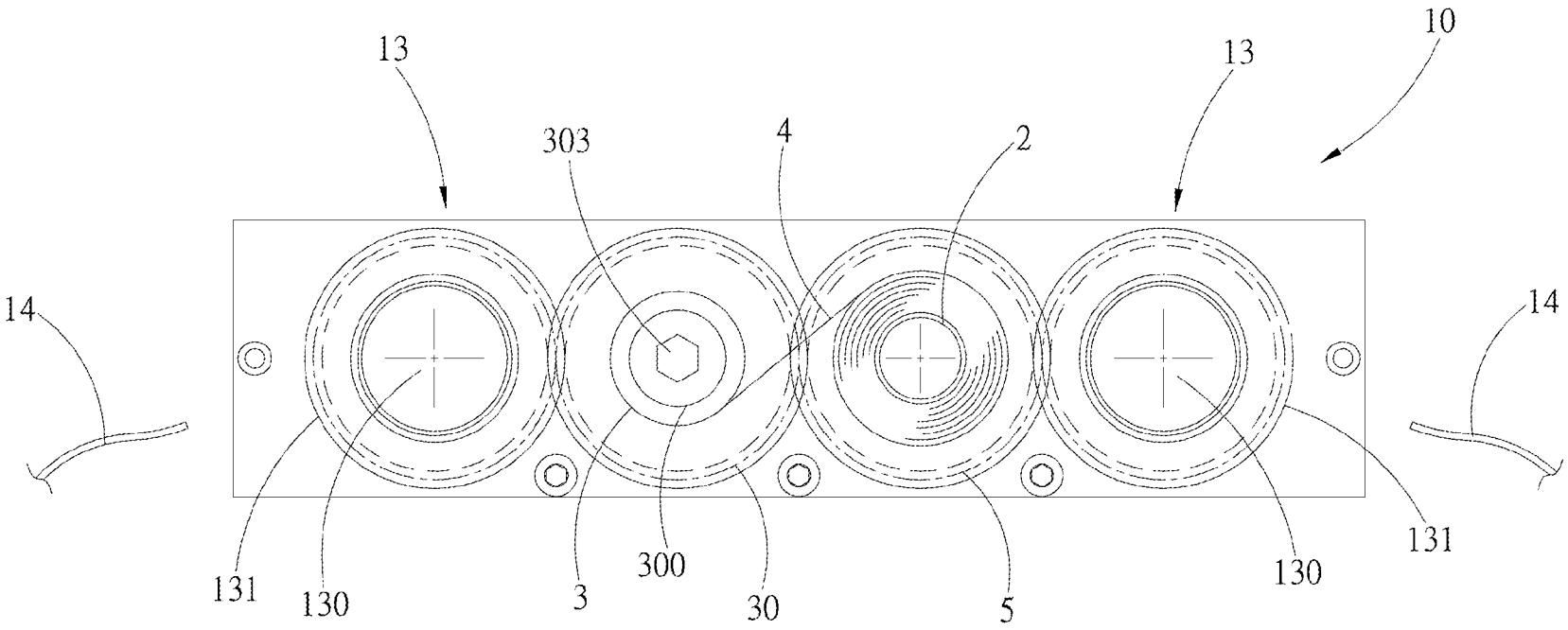
FIG. 10 is a top view of the link angled hole of the present invention.

During the manufacturing process of the spring motor 10, the two side spools 13 must be joined to the two side curtain pull cords 14 to complete the spring motor 10 (as shown in FIG. 10). Moreover, the two side curtain pull cords 14 must be completely wound onto the wheel surfaces of the two side spools 13 in advance to enable driving the taking-in and letting-down of the curtains when fitting the window curtain blind set.

The external surface of the drive drum 3 enables the band head 420 of the coil spring 4 to fasten thereto. Rotation of the drive drum 3 actuates the coil spring 4, and the band body of the sheet band 400 winds onto the surface of the kidney shaped wheel face 301 of the drive drum 3, which produces a feedback preparatory winding force. When the drive drum 3 releases the winding force, then the coil spring 4 rewinds toward the direction of the take-up drum 2 and resets to become the reset coil 41. Through the described process, the mutual meshing relationship of the linkage gear 30, the idler gear 5, and the two side driven gears 131 achieves rotation of the two side spools 13. There is no connection relationship between the inner circumference of the reset coil 41 and the take-up drum 2, with the take-up drum 2 only supporting center rotation positioning of the reset coil 41.

The two side spools 13 are respectively subjected to center rotation supported by the shafts 130 separately associated therewith. The driven gears 131 respectively connected to one end of the two side spools 13 are in a same diameter meshing relationship with the respective linkage gear 30 and the idler gear 5.

Figure 11:
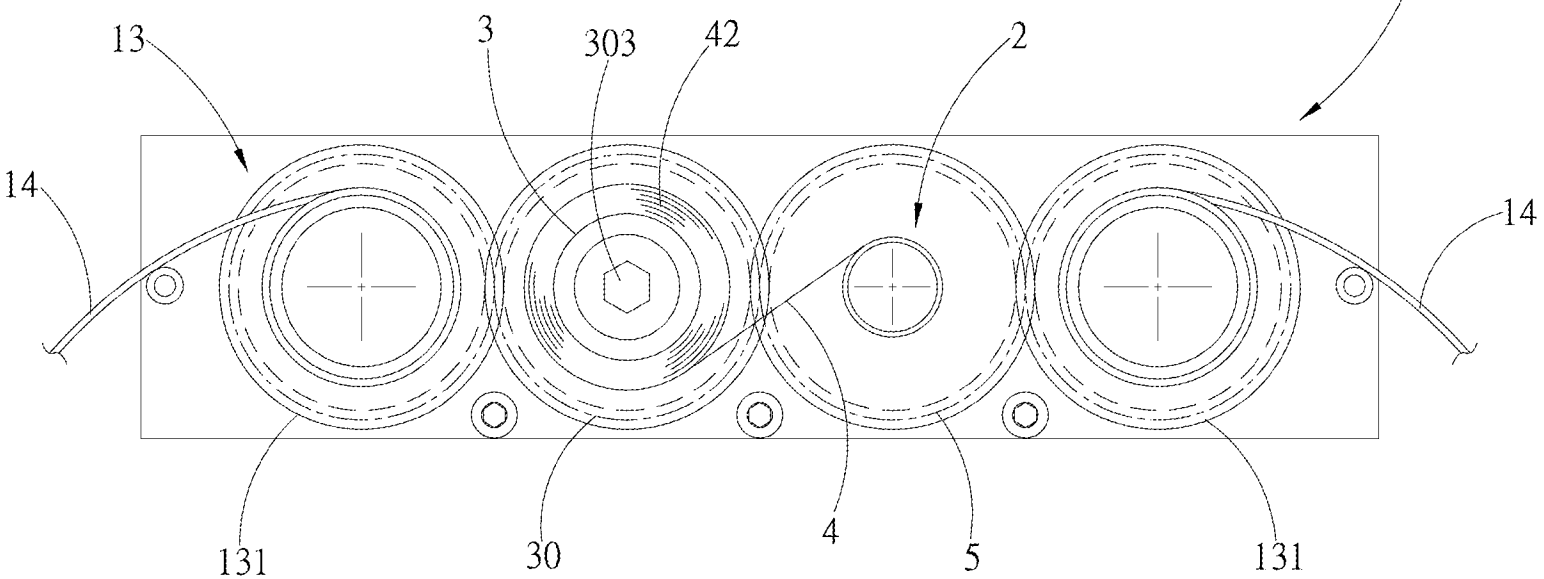
FIG. 11 is a schematic view depicting the drive drum winding round the coil spring to form the pressure accumulating coil according to the present invention.
Figure 12:
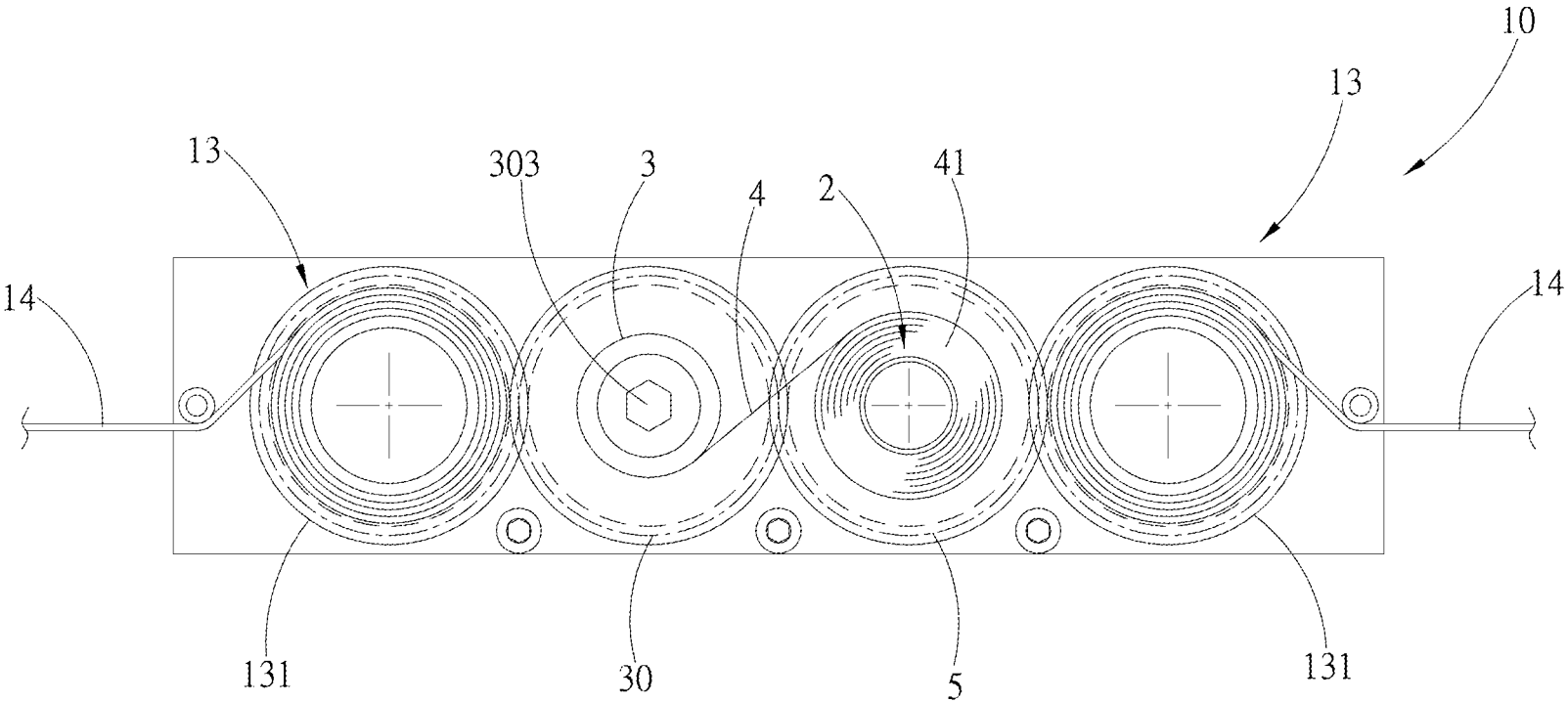
FIG. 12 is a top view depicting the winding round and complete assembly of two side curtain pull cords according to the present invention.

Referring to FIGS. 11 and 12, through the aforementioned actions, actuating the link angled hole 303 drives the drive drum 3 to wind up the coil spring 4, which causes the coil spring 4 to form the pressure accumulating coil 42 on the external surface of the drive drum 3. The pressure accumulating coil 42 then produces a feedback energy and a preparatory wind-up. The cord ends of the two side curtain pull cords 14 are respectively joined to the outer circumferential surfaces of the two side spools 13 to form an effective fixing thereto. The locking of the link angled hole 303 is then released, enabling the pressure accumulating coil 42 to perform a resetting action, which causes the coil spring 4 to reset in the direction of the take-up drum 2 to become the reset coil 41.

Referring to FIG. 12, through the aforementioned resetting action, the coil spring 4 finally resets to become the reset coil 41 based on the take-up drum 2 as center. During the resetting process, the drive drum 3 drives the linkage gear 30, and one side of the linkage gear 30 drives the left side driven gear 131, while the right side driven gear 131 is indirectly driven through the idler gear 5. The two side driven gears 131 respectively drive the spools 13 coaxially associated therewith to carry out winding actions, whereby the curtain pull cords 14 are wound onto the wheel surfaces of the respective spools 13 to complete the spring motor 10.

The drive drum 3 coaxially provided with the link angled hole 303 is used to enable actuation by a tool, which respectively drives the two side spools 13 to perform complete taking up and storing of the curtain pull cords 14. In addition, apart from facilitating producing an assembly operation, the presence of the link angled hole 303 is also required to assist in the assembly process because of changes in the linear stretching force on pull cords at the user end, or the size and shape of the curtain structure are deformed from the original, which causes unequal operating lengths in the two side curtain pull cords 14, at which time the curtain pull cords 14 must be completely removed and reset by assembling the cord ends of the curtain pull cords 14 according to the aforementioned assembly method. The link angled hole 303 can be a general hexagonal hole, which enables a hexagonal tool to carry out the resetting operation.

In addition, the insertion of a tool into the link angled hole 303 can also be used to perform a slow rotary motion to inspect the changing condition of the curved surface of the band body of the coil spring 4 and check whether or not it maintains stable. Hence, the present invention is an effective aided design.

The present invention provides the surface of the kidney shaped wheel face 301 formed on the drive drum 3 with a concave curvature equivalent to that of the cross-sectional curvature of the sheet band 400. Hence, after the sheet band 400 forms the pressure accumulating coil 42, no changes in the cross-sectional curvature of the sheet band 400 will occur, and maintains an appropriate elastic stress, The present invention is clearly an innovative design, accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A curtain spring motor elasticity maintaining structure, comprising a spring motor structure that prevents unproductive deformation of a sheet band of a coil spring, thereby maintaining the intrinsic elastic stress of the sheet band, further comprising:

upper and lower side plates, a supporting shaft and a working end shaft are perpendicularly installed relatively between the inner sides of the upper and lower side plates, with the working end shaft parallel to the supporting shaft; the supporting shaft enables movable disposal of a take-up drum and an idler gear thereon, the idler gear and the take-up drum are in a separation rotational speed relationship;

the working end shaft enables movable disposal of a drive drum thereon, and one end of the drive drum is axially connected to a linkage gear, the linkage gear and the idler gear are in a meshing relationship;

one end of the sheet band is wound onto the take-up drum to form a reset coil, the other end of the sheet band is connected to and wound onto the surface of the drive drum; wherein a surface of the drive drum is a concave curved kidney shaped wheel face, which enables an outer arch face of the sheet band to conform to the concave curved kidney shaped wheel face when wound thereon.

2. The curtain spring motor elasticity maintaining structure according to claim 1, wherein one end of the sheet band is provided with a band head relative to the drive drum; the band head passes through and is clasped in a clasping portion provided on the surface of the drive drum to achieve a connection therewith.

* * * * *